US008516926B1

(12) United States Patent
Hsieh

(10) Patent No.: US 8,516,926 B1
(45) Date of Patent: Aug. 27, 2013

(54) RATCHET WRENCH

(75) Inventor: Chih-Ching Hsieh, Taichung (TW)

(73) Assignee: Kabo Tool Company, Taichung (TW)

( * ) Notice: Subject to any disclaimer, the term of this patent is extended or adjusted under 35 U.S.C. 154(b) by 0 days.

(21) Appl. No.: 13/478,133

(22) Filed: May 23, 2012

(30) Foreign Application Priority Data

Mar. 26, 2012 (TW) ..... 101110393 A

(51) Int. Cl.
*B25B 13/46* (2006.01)

(52) U.S. Cl.
USPC ..... 81/60; 81/63.1

(58) Field of Classification Search
USPC ..... 81/58–63.2
See application file for complete search history.

(56) References Cited

U.S. PATENT DOCUMENTS

| | | | | |
|---|---|---|---|---|
| 3,742,788 | A * | 7/1973 | Priest | 81/61 |
| 6,253,646 | B1 * | 7/2001 | Chang | 81/59.1 |
| 2001/0003933 | A1 * | 6/2001 | Chi et al. | 81/60 |
| 2004/0144212 | A1 * | 7/2004 | Patel et al. | 81/59.1 |

* cited by examiner

*Primary Examiner* — Monica Carter
*Assistant Examiner* — Melanie Alexander
(74) *Attorney, Agent, or Firm* — CKC & Partners Co., Ltd.

(57) ABSTRACT

A ratchet wrench is provided and comprises a main body and at least one strengthening block. The main body includes a handle, at least one tool end and a ratchet-controlling piece. The tool end has a ratchet and an annular portion which has an annular inner wall. The annular portion is connected to the handle, and the ratchet is disposed within the annular inner wall. Furthermore, the strengthening block is removably disposed within the annular portion and a portion of the strengthening block protrudes from the annular inner wall for contacting the ratchet.

7 Claims, 5 Drawing Sheets

RATCHET WRENCH

RELATED APPLICATIONS

The application claims priority to Taiwan Application Serial Number 101110393, filed Mar. 26, 2012, which is herein incorporated by reference.

BACKGROUND

1. Technical Field

The present disclosure relates to a hand tool. More particularly, the present disclosure relates to a ratchet wrench.

2. Description of Related Art

For pursuing firmness and endurance, most of conventional ratchet wrenches are formed by using a material with a high specific weight, good rigidity, and good torsion endurance such as steel or iron. However, the ratchet wrenches formed from the aforementioned material are heavy and require great grip force for operation, thus resulting in soreness or injury to hands after a long-term operation.

If the ratchet wrenches are formed from a lightweight material, although the weight of the ratchet wrenches can be reduced effectively, yet the lightweight material has the disadvantages of soft texture and poor rigidity. As a result, the kind of ratchet wrenches is easily deformed due to poor torsion endurance or quickly worn out due to poor hardness.

SUMMARY

Hence, an aspect of the present invention is to provide a ratchet wrench including a main body and at least one strengthening block. The main body includes a handle, at least one tool end and a ratchet-controlling piece. The tool end has a ratchet and an annular portion having an annular inner wall. The annular portion is connected to the handle and the ratchet is disposed within the annular inner wall. Furthermore, the strengthening block is removably disposed within the annular portion, and a portion of the strengthening block protrudes from the annular inner wall for contacting the ratchet.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
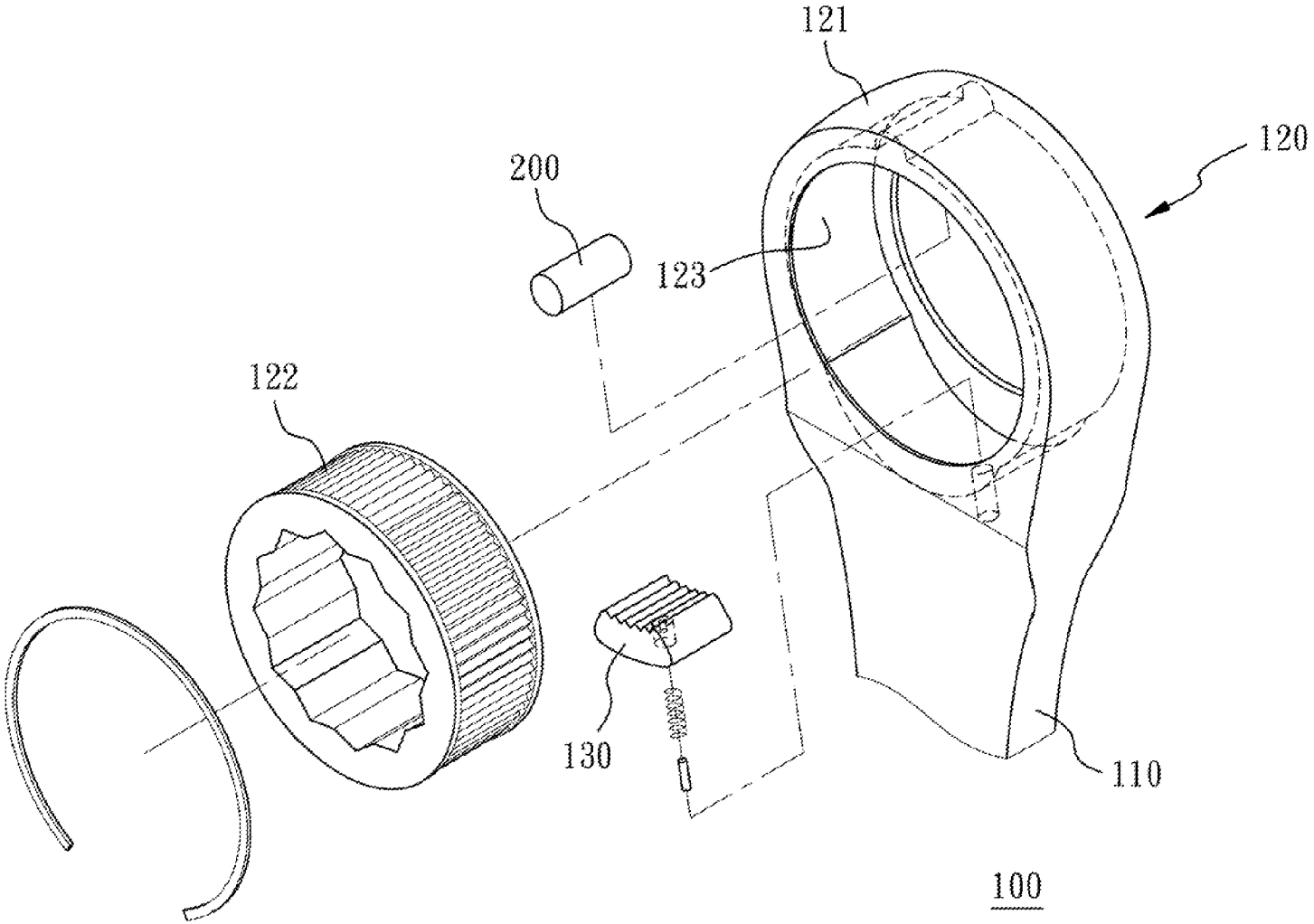
FIG. 1 is an exploded view of a ratchet wrench according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1 is an exploded view of a ratchet wrench according to one in embodiment of the present disclosure. The ratchet wrench comprises a main body 100 and at least one strengthening block 200. The main body 100 has a handle 110, at least one tool end 120, and a ratchet-controlling piece 130. The tool end 120 includes a ratchet 122 and an annular portion 121 having an annular inner wall 123. The annular portion 121 is connected to the handle 110, and the ratchet 122 is disposed within the annular inner wall 123.

Figure 2:
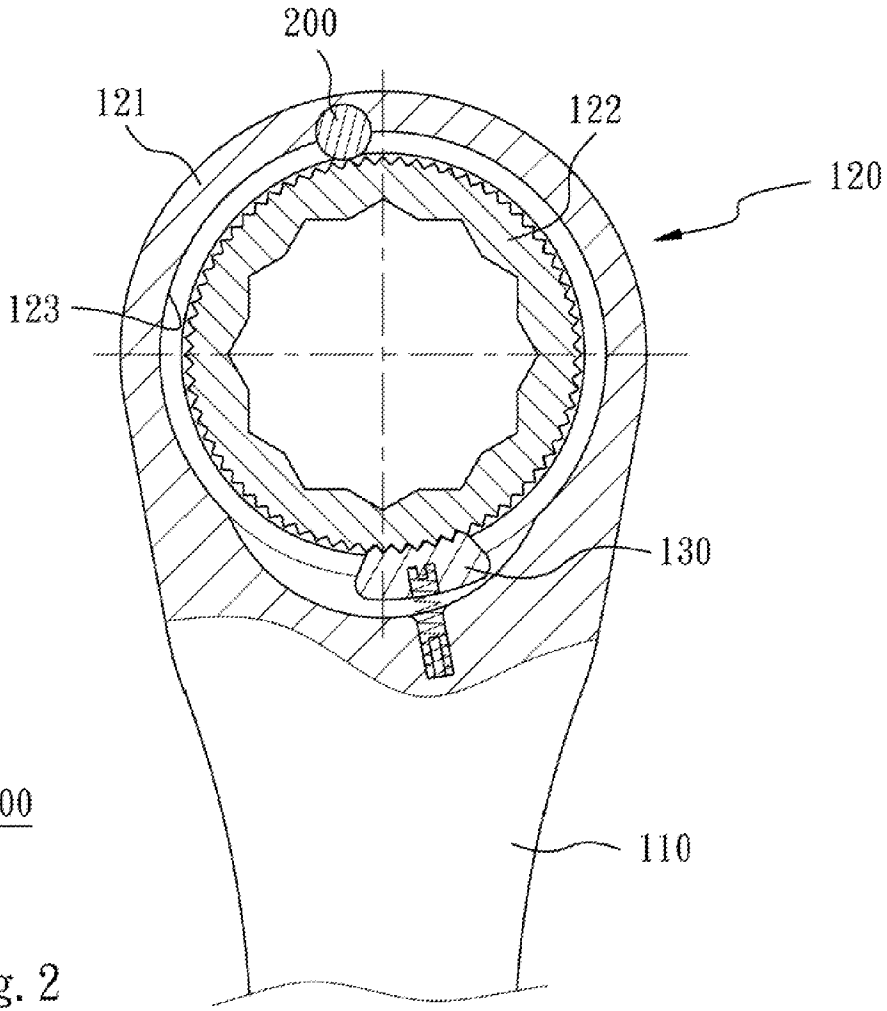
FIG. 2 is a cross-sectional view of a tool end shown in FIG. 1.

FIG. 2 is a cross-sectional view of a tool end 120 shown in FIG. 1. The strengthening block 200 is removably disposed within the annular portion 121, and a portion of the strengthening block 200 protrudes from the annular inner wall 123 for contacting the ratchet 122.

The aforementioned term "strengthening block" means an object with greater hardness and strength than the tool end 120 for enabling the tool end 120 to be strengthened. According to one embodiment of the present disclosure, the main body 100 can be formed from a lightweight material, such as plastic, while the strengthening block 200 can be formed from a high-strength material, such as metal. By means of the portion of the strengthening block 200 with high-strength protruding from the annular inner wall 123 to contact the ratchet 122, the ratchet 122 can be prevented from directly contacting and wearing out the main body 100 with low-strength.

According to one embodiment of the present disclosure, when the ratchet wrench has only one strengthening block 200, the strengthening block 200 is disposed opposite to the ratchet-controlling piece 130. When the ratchet 122 is in operation, due to the influence of the push from the ratchet-controlling piece 130, the position opposite to the ratchet-controlling piece 130 is most easily to be damaged. Therefore, the strengthening block 200 is disposed in the position opposite to the ratchet-controlling piece 130 for enhancing the protection of the tool end 120 from being worn out.

Figure 3:
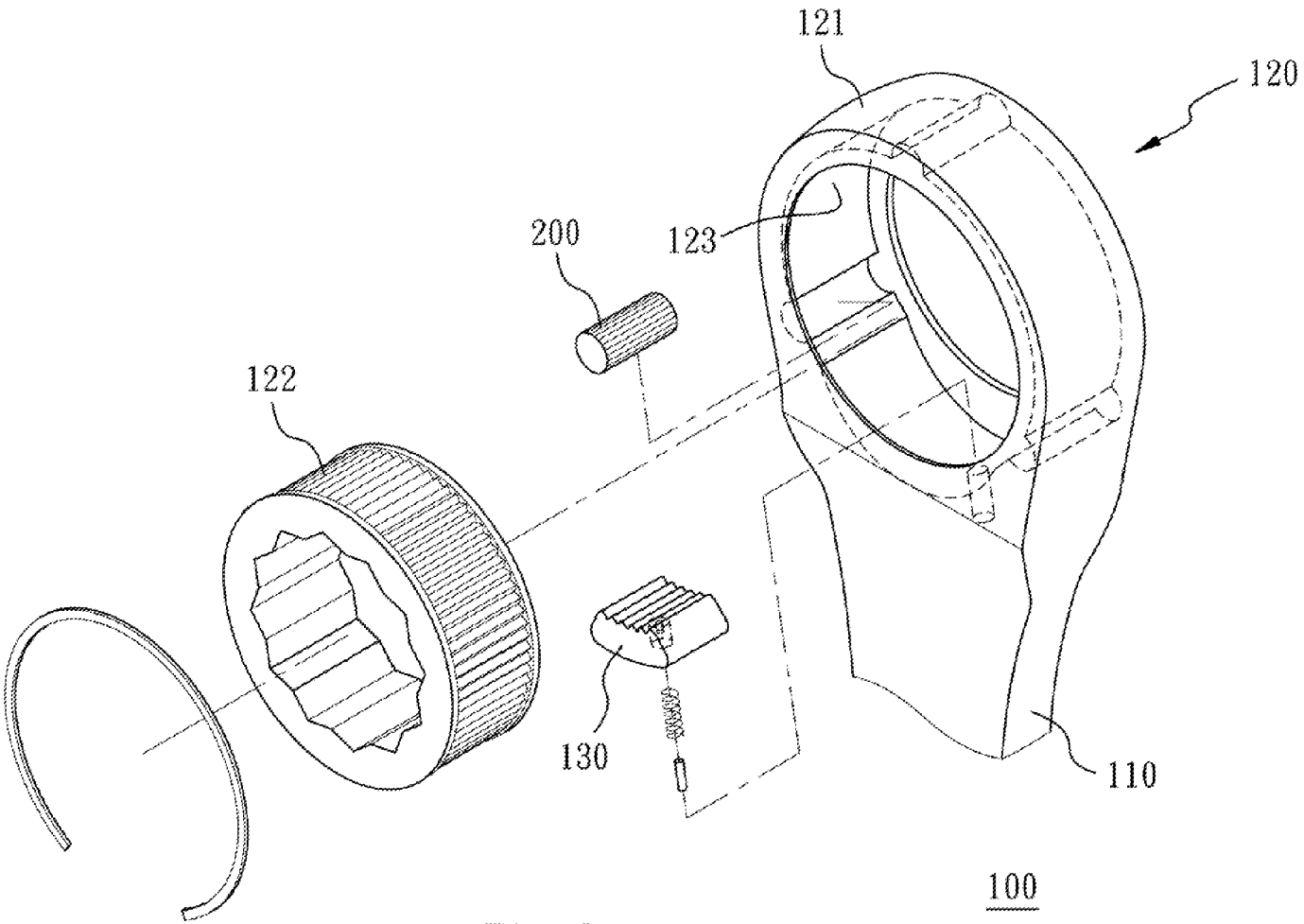
FIG. 3 is an exploded view of a ratchet wrench according to another embodiment of the present disclosure.
Figure 4:
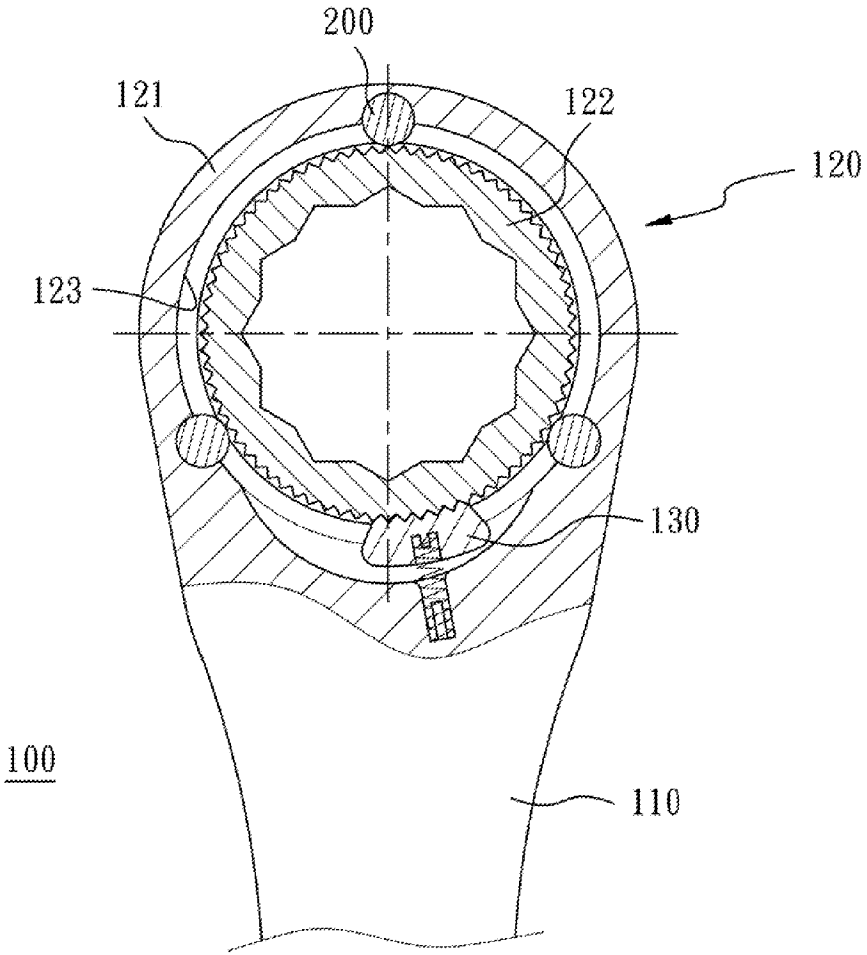
FIG. 4 is a cross-sectional view of a tool end of FIG. 3.

FIG. 3 is an exploded view of a ratchet wrench according to another embodiment of the present disclosure. FIG. 4 is a cross-sectional view of a tool end 120 shown in FIG. 3. In FIG. 4, when the ratchet wrench has a plurality of strengthening blocks 200, every two adjacent strengthening blocks 200 are spaced at a substantially equal distance.

According to one embodiment of the present disclosure, wherein the strengthening blocks 200 have an extending axis which is parallel to a central axis of the annular portion 121, and a thickness of each strengthened block 200 is about equal to a thickness of the annular portion 121. Therefore, the strength of the tool end 120 is further reinforced.

According to one embodiment of the present disclosure, wherein a surface of the strengthening block 200 contacting the ratchet 122 has textures formed thereon, thereby enabling the strengthening block 200 to be engaged with the ratchet 122.

Figure 5:
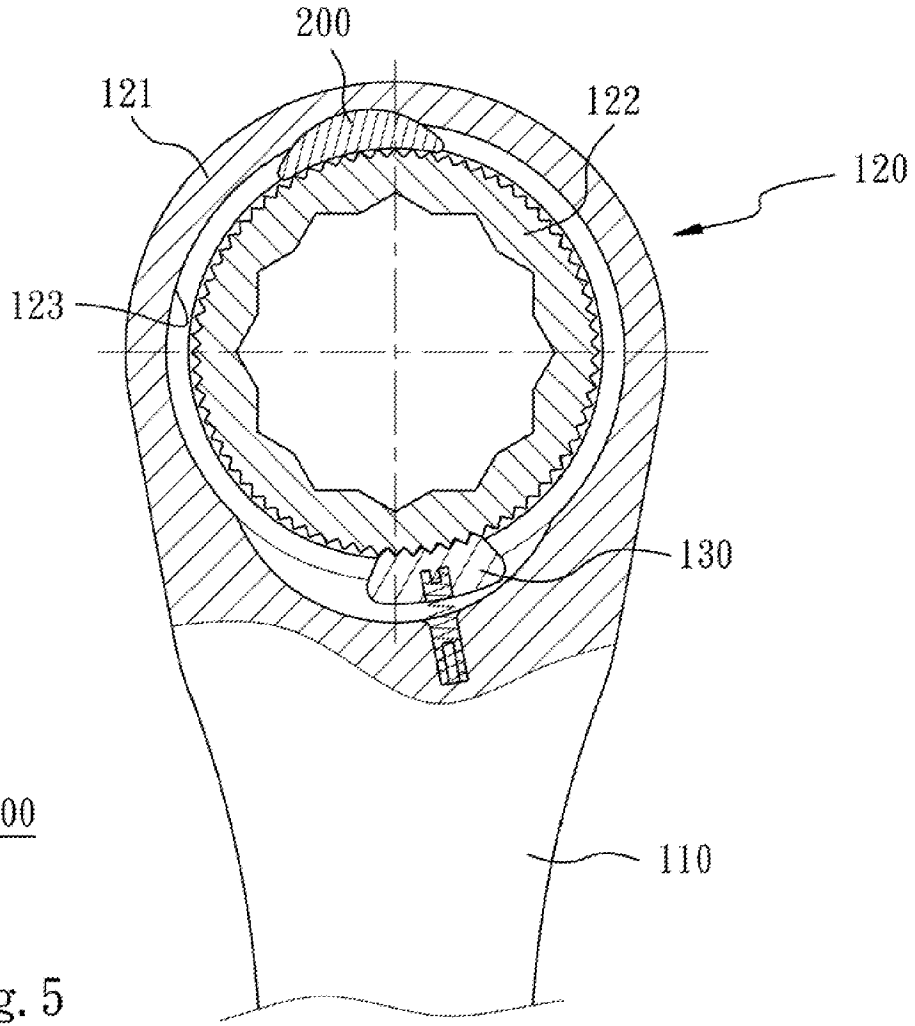
FIG. 5 is a cross-sectional view of a tool end of a ratchet wrench according to yet another embodiment of the present disclosure.

The strengthening block 200 of the present disclosure can be a cylinder, as shown in FIG. 1 to FIG. 4. FIG. 5 is a cross-sectional view of a tool end 120 of a ratchet wrench according to yet another embodiment of the present disclosure. In FIG. 5, a strengthening block 200 is a half moon cylinder.

According to the foregoing embodiments of the disclosure, by using the strengthening block to strengthen the tool end and by adopting a lightweight material to form the main body of the ratchet wrench, the weight of the ratchet wrench can be reduced and the strength of the tool end can be maintained at the same time.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A ratchet wrench, comprising:

a main body comprising a handle, at least one tool end, and a ratchet-controlling piece, wherein the tool end comprises:

an annular portion which is connected to the handle and has an annular inner wall; and a ratchet disposed within the annular inner wall; and only one strengthening block removably disposed within the annular portion, wherein the strengthening block is disposed opposite to the ratchet-controlling piece, and a portion of the strengthening block protrudes from the annular inner wall for contacting the ratchet.

2. The ratchet wrench of claim 1, wherein the strengthening block has an extending axis which is parallel to a central axis of the annular portion, and a thickness of the strengthening block is substantially equal to a thickness of the annular portion.

3. The ratchet wrench of claim 1, wherein a surface of the strengthening block contacting the ratchet has textures formed thereon so as to engage with the ratchet.

4. The ratchet wrench of claim 1, wherein the strengthening block is a cylinder.

5. The ratchet wrench of claim 1, wherein the strengthening block is a half moon cylinder.

6. The ratchet wrench of claim 1, wherein the main body is formed from plastic.

7. The ratchet wrench of claim 1, wherein the strengthening block is formed from metal.

* * * * *